US006705901B1

(12) United States Patent
Lin

(10) Patent No.: US 6,705,901 B1
(45) Date of Patent: Mar. 16, 2004

(54) AUTOMOBILE ELECTRICAL CONNECTOR

(75) Inventor: Yiason Lin, Shu-Lin (TW)

(73) Assignee: L & K Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 10/304,753

(22) Filed: Nov. 27, 2002

(51) Int. Cl.[7] ..... H01R 24/04
(52) U.S. Cl. ..... 439/668; 439/490
(58) Field of Search ..... 439/76.1, 668, 439/669, 490, 489

(56) References Cited

U.S. PATENT DOCUMENTS 4,319,798 A * 3/1982 Mittelhauser
5,199,904 A * 4/1993 Wharton ..... 439/675
5,964,623 A * 10/1999 Maher et al. ..... 439/668
6,296,526 B1 * 10/2001 Hussaini et al. ..... 439/668
6,394,851 B1 * 5/2002 Paciorek ..... 439/668

* cited by examiner

*Primary Examiner*—Khiem Nguyen
(74) *Attorney, Agent, or Firm*—Troxell Law Office PLLC

(57) ABSTRACT

An automobile electrical connector comprises an elongated housing. The elongated housing includes a first housing and a second housing assembled together. A biasing spring, a contact spring and a compression spring are mounted on the elongated housing for elastically connecting with a socket of an automobile. A first groove is defined in a surface of the first housing and is enclosed by a photic panel. An opening is defined through the first groove. A lighting block is opposite to the opening and electrically connects with a circuit board for lighting, thereby indicating electrical connection.

7 Claims, 5 Drawing Sheets

AUTOMOBILE ELECTRICAL CONNECTOR

BACKGROUND OF THE INVENTION

1. Field of the Invention

This invention relates to an automobile electrical connector, particularly to an automobile electrical connector having light indication of electrical connection.

2. Background of the Invention

Currently, electrical sockets are extensively provided in automobiles for electrical connections of smoking device, vacuum cleaner, air compressor, mobile communication, etc. For example, a connector has the shape similar to a smoking device for mating with the electrical socket. The connector has an elongated housing insertable to the electrical socket. An electrical circuit is provided in the housing, which connects with the electrical socket by a biasing spring and a contact spring for electrical connection. However, electrical contact area therebetween is so long that it is through a long way that the elongated housing inserts to the electrical socket for the contact spring contacting a terminal of the electrical socket. Moreover, users cannot see if electrical connection is successful. For example, a mobile phone is expected to be charging via the electrical socket, but in fact fails to be electrically connected to the electrical socket, which is often troublesome.

Additionally, an elongated housing of a conventional automobile electrical connector is ejection shaped of the same material. The quality of the electrical connector is limited by the shaping technology and material cost, and appearance thereof is also affected.

BRIEF DESCRIPTION OF THE INVENTION

1. Objectives of This Invention

The main objective of this invention is to provide an automobile electrical connector having light indication for electrical connection between an electrical socket and a connector of an electrical device.

Another objective of this invention is to provide an automobile electrical connector having a replaceable ornamental panel, which provides different assembly structure and improves appearance of the electrical connector without limitation of shaping technology.

The automobile electrical connector is featured of an opening opposite to a contact end for electrical connection. A circuit board corresponds to the opening and electrically connects with a lighting block, which connects with power for light indication of electrical connection.

At least one photic panel is formed on the elongated housing and corresponds to the opening for transmitting light.

A light emission panel is provided between the photic panel and the opening for enlarging light area upon the photic panel.

BRIEF DESCRIPTION OF DRAWINGS

The drawings of preferred embodiments of this invention are described in details to enable better understanding.

DETAILED DESCRIPTION OF PREFERRED EMBODIMENTS

Figure 1:
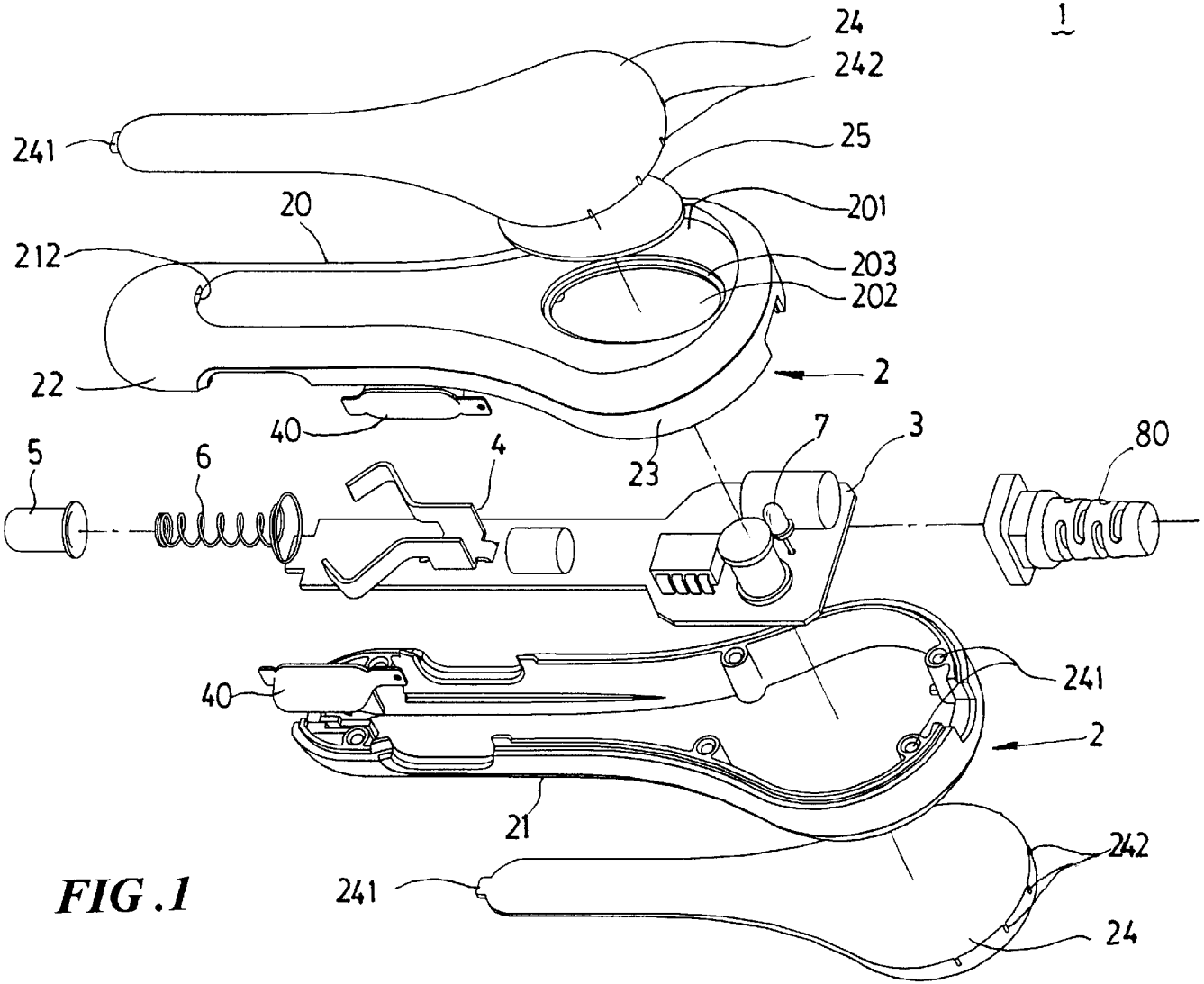
FIG. 1 is an exploded view of an automobile electrical connector of the present invention.
Figure 4:
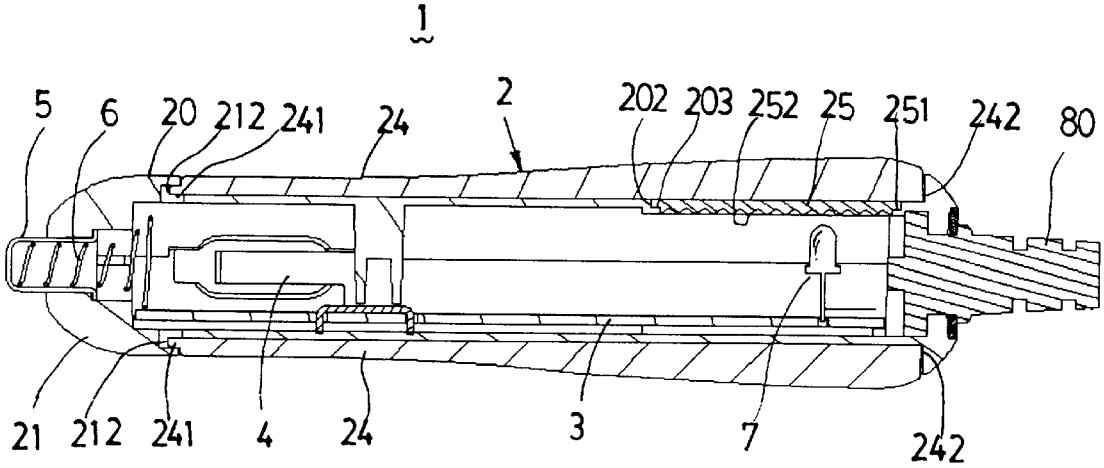
FIG. 4 is a cross-sectional view taken from the line 4—4 of FIG. 3.

As shown in FIG. 1, an automobile electrical connector 1 in accordance with the present invention comprises an elongated housing 2, a circuit board 3, a biasing spring 4, a contact spring 5, and a compression spring 6. The elongated housing 2 includes a first housing 20 and a second housing 21, which are integrally assembled together. The first housing 20 has a contact end 22 and an engaging end 23. A first groove 201 is defined in a surface of the first housing 20 adjacent to the engaging end 23. The first groove 201 has a shape corresponding to inside periphery of the elongated housing 2. A photic panel 24 encloses the first groove 201 and is formed of qualified material to fit for the first housing 20. With reference to FIG. 4, a latch 241 is provided at an end of the photic panel 24. A first cutout 212 is defined in an edge of inner of the first groove 201 adjacent to the contact end 22 for locking with the latch 241. A plurality of tabs 242 is formed on an end of the photic panel 24 opposite to the latch 241 for cooperating with the first groove 201 thereby retaining the photic panel 24 onto the first groove 201. An opening 202 is substantially defined in the center of the first groove 201 adjacent to the engaging end 23. An edge 203 borders the opening 202 for mounting a light emission panel 25 thereon. A projection 251 is formed on an outer periphery of the light emission panel 25 for cooperating with the edge 203. A plurality of strips 252 is formed on the light emission panel 25 and is parallel with each other. The light emission panel 25 abuts against the photic panel 24 in assembly (referring to FIG. 4).

Figure 2:
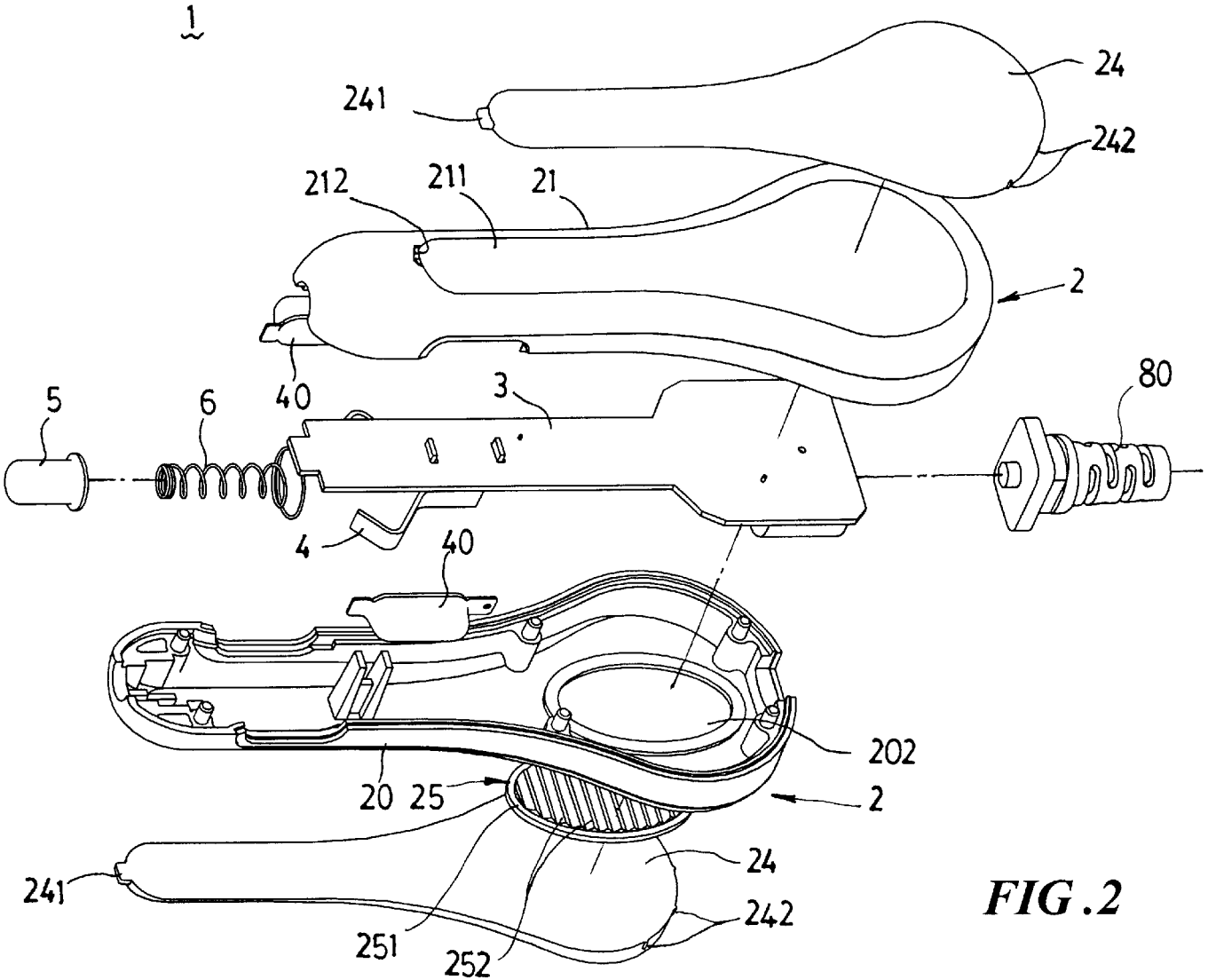
FIG. 2 is similar to FIG. 1, where the automobile electrical connector is upside down.
Figure 3:
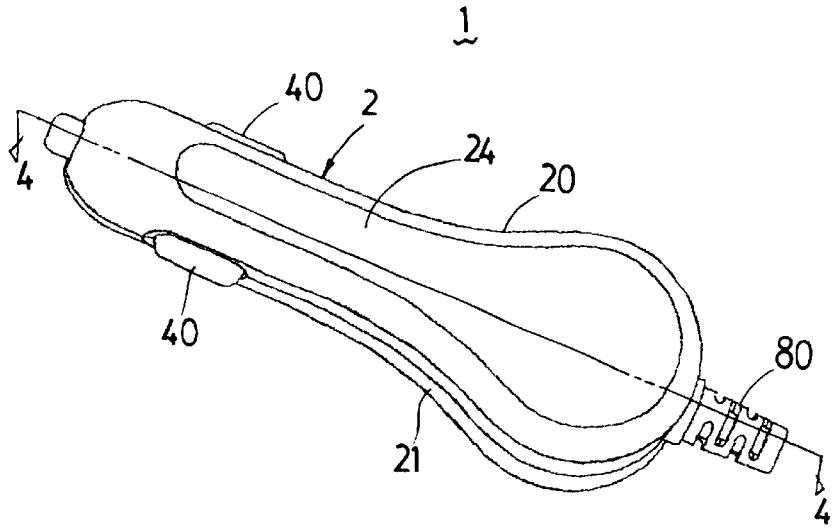
FIG. 3 is an assembled view of this invention of the automobile electrical connector of FIG. 1.

As shown in FIG. 2, the second housing defines a second groove 211 therein. The second groove 211 has a shape similar to the first groove 201 and corresponding to inside periphery of the elongated housing 2. A photic panel 24 encloses the second groove 211. A latch 241 is provided at an end of the photic panel 24. A second cutout 212 has a shape similar to the first cutout 212 for locking with the latch 241. A plurality of tabs 242 is formed on an end of the photic panel 24 opposite to the latch 241 for cooperating with the second groove 211 thereby retaining the photic panel 24 onto the second groove 211.

The circuit board 3 is sandwiched between the first housing 20 and the second housing 21. The biasing spring 4, the contact spring 5, and the compression spring 6 electrically connect with the circuit board 3. The biasing spring 4 has a cap 40 beyond opposite sides of the elongated housing 2. The compression spring 6 abuts the contact spring 5. A lighting block 7 is provided on the circuit board 3 and is defined opposite to the opening 202 of the first housing 20. The lighting block 7 is a LED in this embodiment, and electrically connects with a power of the circuit board 3 for lighting indication.

With reference to FIGS. I through 4, in assembly, the circuit board 3 is first received in the second housing 21. The cap 40 of the biasing spring 4, the compression spring 6, the contact spring 5 and a strain relief 80 of a cable 8 (shown in FIG. 5) are placed in sequence. The first housing 20 engages with the second housing 21, where the lighting block 7 is opposite to the opening 202. The light emission panel 25 is mounted above the opening 202. A pair of photic panels 24 fit into the first groove 201 and the second groove 211, respectively. The tabs 242 of the photic panels 24 correspondingly abut against the first housing 20 and the second housing 21.

Figure 5:
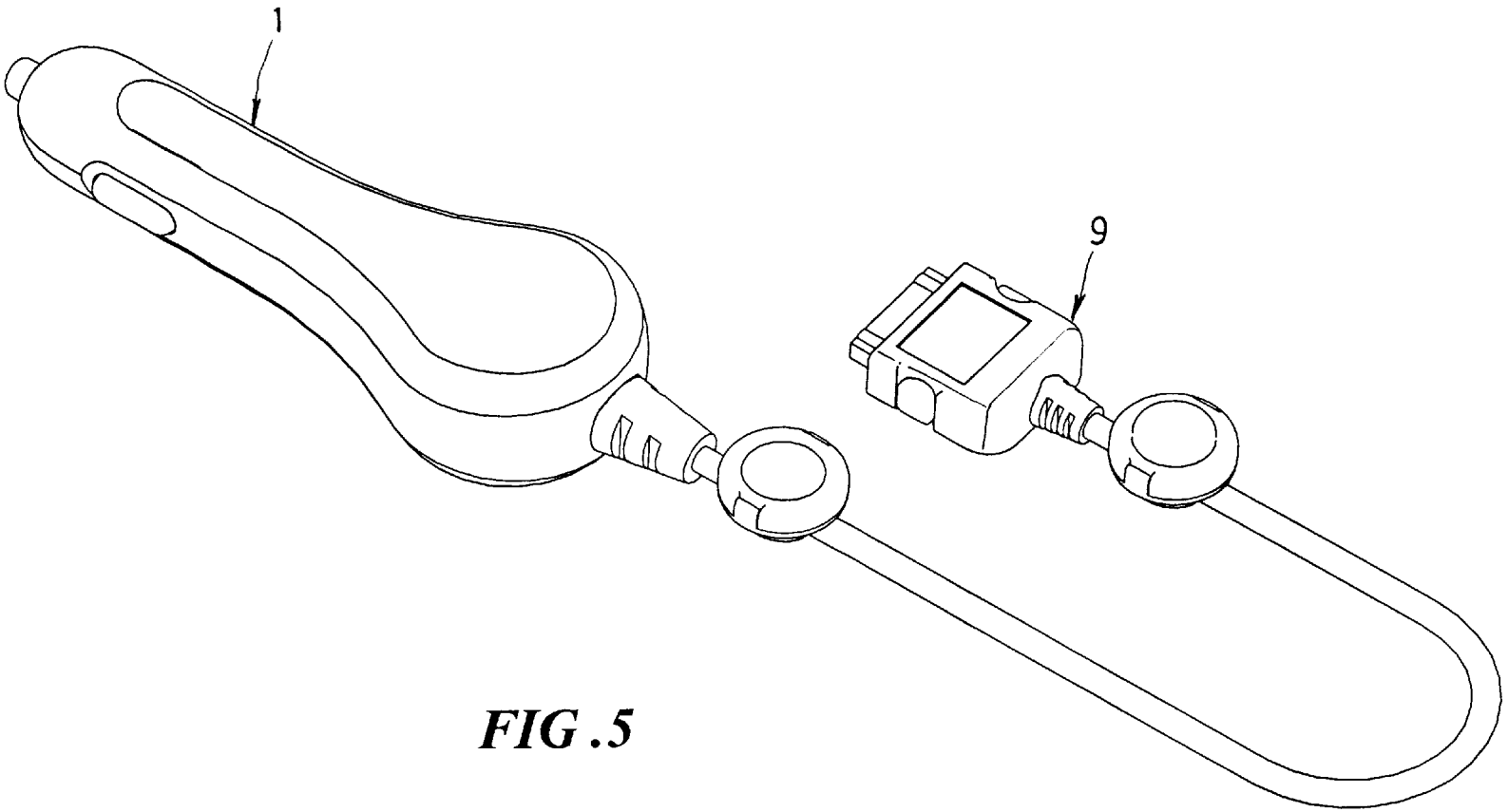
FIGS. 5 and 6 are perspective views of a mobile phone connector being assembled to the automobile electrical connector of FIG. 1.
Figure 6:
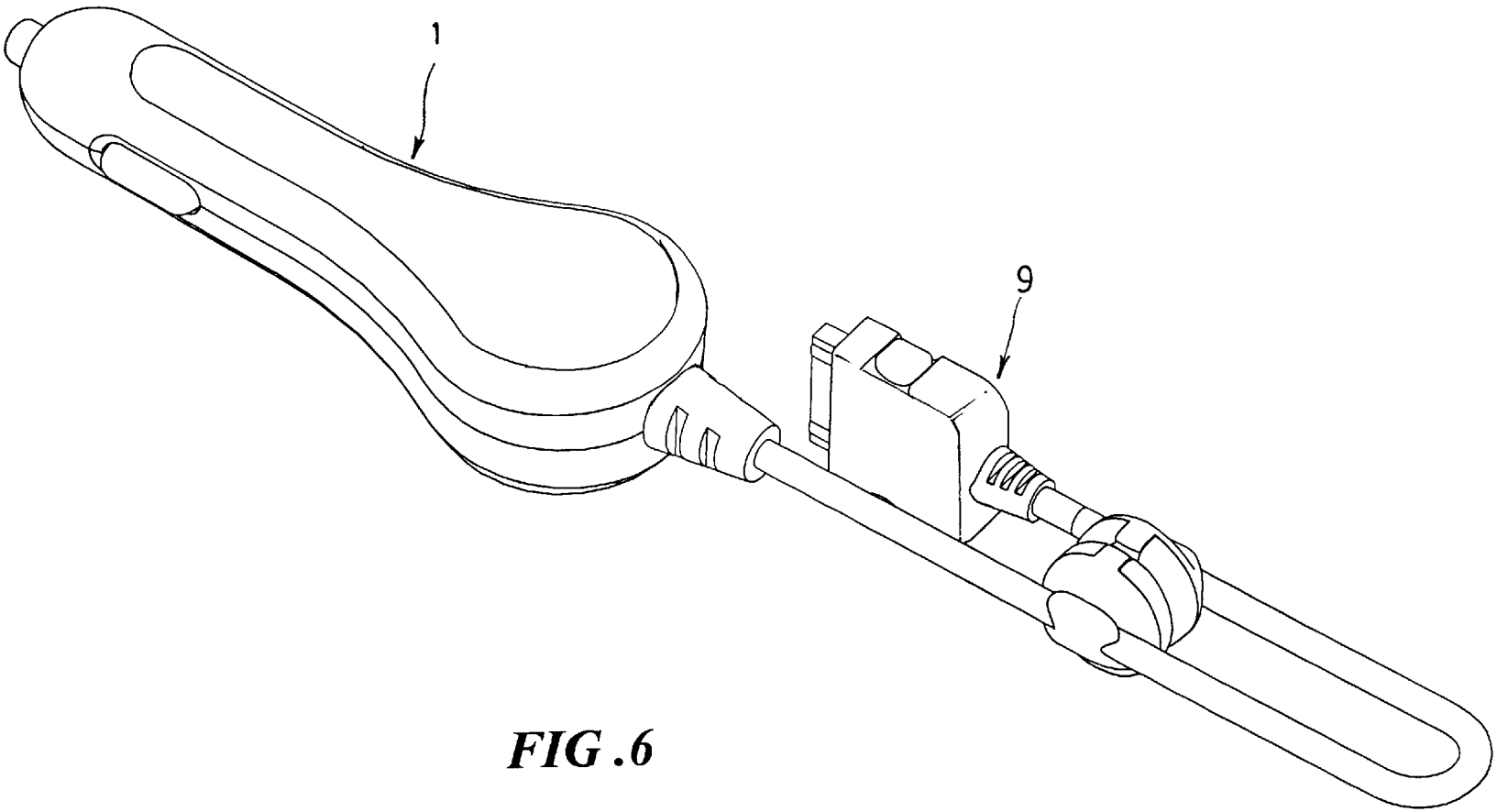

FIGS. 5 and 6 show a mobile phone connector 9 assembled to the automobile electrical connector 1. The cable 8 has opposite ends respectively connecting with the mobile phone connector 9 and the automobile electrical connector 1. When the automobile electrical connector 1 contacts an electrical socket on the automobile (not shown), the lighting block 7 immediately lights through the light emission panel 25, whereby users know that the mobile phone connector 9 has electrical connection with the automobile electrical connector 1 successfully.

As evidenced in the above description, this invention is capable of achieving its anticipated objective, which has satisfied the requirement for a patent. It should be declared herewith that the above description covering only the preferred embodiment of this invention could not be based to restrict the scope of application of this invention, and that all modifications or variations made within the scope of the claims shall be included in this patent right.

What is claimed is:

1. An automobile electrical connector, adapted to connect with a electrical socket of an automobile, comprising:

an elongated housing including a first housing and a second housing which are assembled together, the first housing having a contact end and an engaging end; and a circuit board being sandwiched between the first housing and the second housing, and electrically connecting with a biasing spring, a contact spring and a compression spring; wherein:

a first groove being defined in a surface of the first housing adjacent to the engaging end and being enclosed by a photic panel, an opening being defined through the first groove; and a lighting block being accommodated in the opening and electrically connecting with the circuit board for light indication of electrical connection.

2. The automobile electrical connector claimed in claim 1, further comprising a light emission panel between the photic panel and the opening for enlarging the light area on the photic panel.

3. The automobile electrical connector claimed in claim 2, wherein a latch is provided at an end of the photic panel, a first cutout is defined in an edge of inner of the first groove adjacent to the contact end for locking with the latch, and a plurality of tabs is formed on an end of the photic panel opposite to the latch for cooperating with the first groove.

4. The automobile electrical connector claimed in claim 1, wherein an edge borders the opening, and a projection is formed on an outer periphery of the light emission panel for cooperating with the edge.

5. The automobile electrical connector claimed in claim 1, wherein a second groove is defined in the second housing and has a shape similar to the first groove.

6. The automobile electrical connector claimed in claim 5, wherein the first groove and the second housing each has a shape corresponding to inside periphery of the elongated housing.

7. The automobile phone connector claimed in claim 1, wherein a plurality of strips is formed on the light emission panel and is parallel with each other.

* * * * *